US005871208A

United States Patent [19]

Hirai et al.

[11] Patent Number: 5,871,208

[45] Date of Patent: Feb. 16, 1999

[54] SHEET CONVEY APPARATUS WITH HORIZONTAL SHEET STACKING PLATE ABOVE CONVEY MEANS

[75] Inventors: Katsuaki Hirai, Yokohama; Masataka Naito, Kawasaki, both of Japan

[73] Assignee: Canon Kabushiki Kaisha, Tokyo, Japan

[21] Appl. No.: 937,802

[22] Filed: Sep. 25, 1997

Related U.S. Application Data

[63] Continuation of Ser. No. 572,502, Dec. 14, 1995, abandoned, which is a continuation of Ser. No. 207,727, Mar. 9, 1994, abandoned.

[30] Foreign Application Priority Data

Mar. 11, 1993 [JP] Japan ..... 5-077751

[51] Int. Cl.[6] ..... B65H 5/00

[52] U.S. Cl. ..... 271/3.01; 271/123

[58] Field of Search ..... 271/3.01, 123

[56] References Cited

U.S. PATENT DOCUMENTS

| | | | |
|---|---|---|---|
| 4,231,562 | 11/1980 | Hori | 271/3.1 |
| 4,607,948 | 8/1986 | Naito . | |
| 4,869,488 | 9/1989 | Hirota et al. | 271/3.1 |
| 5,062,602 | 11/1991 | Kress et al. | 271/123 X |
| 5,074,537 | 12/1991 | van Rijn | 271/3.1 |
| 5,096,177 | 3/1992 | Saeki et al. | 271/3.1 |
| 5,116,036 | 5/1992 | LeRoy et al. | 271/3.1 |
| 5,117,266 | 5/1992 | Takemura et al. | 271/3.1 X |
| 5,132,741 | 7/1992 | Kitajima et al. | 271/3.1 X |
| 5,183,240 | 2/1993 | Morooka et al. | 271/3.1 |
| 5,186,446 | 2/1993 | Saeki et al. | 271/3.1 |
| 5,195,733 | 3/1993 | Takimoto et al. | 271/3.1 |

FOREIGN PATENT DOCUMENTS

| | | | |
|---|---|---|---|
| 23040 | 1/1986 | Japan | 271/3.1 |
| 127931 | 5/1988 | Japan | 271/3.1 |
| 196425 | 8/1988 | Japan | 271/3.1 |
| 282043 | 11/1988 | Japan | 271/3.1 |
| 59527 | 2/1992 | Japan | 271/123 |
| 2000749 | 1/1979 | United Kingdom | 271/3.1 |
| 2248439 | 4/1992 | United Kingdom . | |

OTHER PUBLICATIONS

"Recirculating Automatic Document Feeder", IBM Technical Disclosure Bulletin, pp. 2228–2229 (Nov. 1979).

"Document Handler Stack Sensor", Wenthe, Jr., Xerox Disclosure Journal, vol. 6, No. 4, p. 167 (Jul./Aug. 1981).

*Primary Examiner*—William E. Terrell
*Assistant Examiner*—Khoi H. Tran
*Attorney, Agent, or Firm*—Fitzpatrick, Cella, Harper & Scinto

[57] ABSTRACT

The present invention provides a sheet convey apparatus with a sheet stacking plate, supply roller for conveying a sheet from the sheet stacking plate, a separating device for separating or supplying the conveyed sheet to a treatment portion, a conveyer for conveying the sheet on the treatment portion, a discharger for discharging the sheet from the treatment portion onto the sheet stacking plate again, and an apparatus body cover. The sheet stacking plate cooperates with the cover to form a substantially horizontal sheet stacking surface and is arranged immediately above the conveyor.

7 Claims, 11 Drawing Sheets

SHEET CONVEY APPARATUS WITH HORIZONTAL SHEET STACKING PLATE ABOVE CONVEY MEANS

This application is a continuation of application Ser. No. 08/572,502, filed Dec. 14. 1995, now abandoned, which is a continuation of application Ser. No. 08/207,727, filed Mar. 9, 1994, now abandoned.

BACKGROUND OF THE INVENTION

1. Field of the Invention

The present invention relates to a sheet convey apparatus for automatically supplying and discharging a sheet to and from a treatment portion. More particularly, the present invention relates to a sheet convey apparatus adapted to automatically supply and discharge a sheet with respect to an image reading portion of an image forming apparatus such as a copying machine, laser beam printer (LBP), image reading apparatus, image recording apparatus and the like, and an image forming apparatus having such a sheet convey apparatus.

2. Related Background Art

FIG. 13 shows an example of a conventional sheet convey apparatus. The sheet convey apparatus shown in this example is an original (document) feed apparatus (ADF).

In FIG. 13, a platen glass 2 acting as an image reading treatment portion is fixed to an upper surface of a body 1 of an image forming apparatus such as a copying machine, LBP and the like. An internal construction of the image forming apparatus will be described later.

An original convey apparatus including the platen glass 2 is generally designated by the reference numeral 3 and is mounted on the upper surface of the image forming apparatus. The original convey apparatus 3 comprises an outer cover (main cover) 4, and an original tray 5 acting as an original stacking plate on which sheet originals S are stacked in such a manner that leading or tip ends of the sheet originals are inserted in an original inlet portion 20.

When a semi-circular sheet supply roller 6 is rotated in response to an original supply start signal, a positive feeding force is applied to a lowermost sheet original of the sheet original stack S on the original tray 5, and the lowermost sheet original alone is separated from the other sheet originals at a separation and supply portion comprising a feed roller 7 and a separation belt 8, and the separated sheet original is supplied into the original convey apparatus 3. The separated sheet original passes through a sheet path a, a pair of register rollers 9 and a sheet path b, and is sent between the platen glass 2 and a rotatable original convey belt 10.

The pair of register rollers 9 serve to correct the skew-feed of the sheet original by abutting the tip end of the sheet original against a nip between the rollers and also to provide the sheet supply timing with respect to the platen glass 2.

The rotatable original convey belt 10 serves to convey the sheet original on the platen glass 2, and extends between and wound around a drive roller 11 disposed at a left end of the platen glass 2 and a turn roller 12 disposed at a right end of the platen glass 2 in such a manner that a lower running belt portion is urged against the platen glass 2 by a plurality of urging rollers 13. The original convey belt 10 is rotated in an anti-clockwise direction shown by the arrow so that the sheet original conveyed between the platen glass 2 and the belt 10 from the sheet path b is conveyed along a sheet path c between the platen glass 2 and the belt 10 from the left to the right of the platen glass 2 while sliding on the platen glass. When the sheet original is conveyed to a predetermined set position on the platen glass, the original convey belt 10 is stopped, thereby automatically setting the sheet original at the predetermined set position. Then, image information on the sheet original set on the platen glass is read by a reading mechanism of the image forming apparatus. When the reading treatment is finished, the original convey belt 10 is rotated in the counter-clockwise direction again to shift the sheet original to the right along the upper surface of the platen glass 2. Then, the sheet original is discharged onto a discharge tray 16 disposed between the original tray 5 and the original convey belt 10 through a sheet path d, a pair of discharge rollers 14 and a discharge opening 15.

In this way, a cycle wherein the sheet originals S are successively supplied from the original tray 5 to the platen glass 2 one by one and are read on the platen glass and then are discharged onto the discharge tray 16 successively is automatically performed.

FIG. 14 shows another example of a conventional original convey apparatus (recirculating document feeder, i.e., RDF). The same constructual elements as those shown in FIG. 13 are designated by the same reference numerals and explanation thereof will be omitted.

As is in the apparatus shown in FIG. 13, sheet originals S stacked on an original tray 5 are separated one by one from the lowermost one by a sheet supply roller 6 and separation and supply portion 7, 8, and the separated sheet original is automatically conveyed to a platen glass 2 through a sheet path a, a pair of regist rollers 9 and a sheet path b to be set on the platen glass at a predetermined position. Then, image information on the sheet original is read. When the reading treatment is finished, a rotatable original convey belt 10 is rotated reversely in a clockwise direction to return the sheet original on the platen glass 2 to the left to introduce the sheet original into a return sheet path e. Then, the sheet original is discharged onto the non-treated sheet original stack S on the original tray 5 through a reverse rotation path f along a large reverse rotation roller 17, a discharge path g, a pair of discharge rollers 14 and a discharge opening 15.

A first supply, reading treatment and discharge cycle for the sheet originals S stacked on the original tray 5 is completed, a new supply, reading treatment and discharge cycle for the sheet originals returned onto the original tray 5 is started. In this way, a predetermined number of original convey circulations are carried out. In FIG. 14, there are provided a sheet path switching flapper 19 and a branch sheet path h. In case of both-face imaged sheet originals, each sheet original a first face of which was read is introduced from the reverse rotation path f to the branch sheet path h, so that the sheet original is re-supplied to the platen glass 2 with a second face thereof facing downwardly. Incidentally, urging rollers 18 serve to urge the sheet original against the large reverse rotation roller 17.

However, in the above conventional sheet convey apparatus as shown in FIG. 13, since an upper space above the discharge tray 16 is limited because of the presence of the original tray (sheet stacking plate) 5, the number of sheet originals to be treated is limited. If the number of sheet originals to be treated is increased, the apparatus becomes large-sized accordingly.

On the other hand, in the conventional sheet convey apparatus as shown in FIG. 14, since it is of circulating type, it is necessary to improve the re-supplying ability for re-supplying the sheet originals from the original tray 5, with the result that the original tray must be arranged with a large inclination angle, thereby making the apparatus large-sized.

SUMMARY OF THE INVENTION

The present invention aims to eliminate the above-mentioned conventional drawbacks, and an object of the present invention is to provide a sheet convey apparatus and an image forming apparatus having such a sheet convey apparatus, which is compact and is easy to handle.

To achieve the above object, a sheet convey apparatus according to the present invention comprises a sheet stacking plate, supply means for conveying a sheet from the sheet stacking plate to a treatment portion, convey means for conveying the sheet at the treatment portion, discharge means for discharging the sheet from the treatment portion onto the sheet stacking plate, and a cover. Wherein, the sheet stacking plate cooperates with the cover to provide a substantially horizontal sheet stacking surface and is arranged immediately above the convey means.

According to the present invention, since the sheet stacking surface can also be used as a sheet discharge surface, the number of sheets to be treated is not limited.

Since the sheet stacking surface is formed substantially horizontally by the cooperation of the stacking plate and the cover and since the stacking plate is disposed immediately above the convey means for conveying the sheet at the treatment portion, a height of the apparatus can be reduced, thereby making the apparatus small-sized. Further, since the sheet stacking surface is positioned substantially horizontally, the treated sheets returned to and re-stacked on the non-treated sheet stack are not positively moved in a sheet supply direction, thereby minimizing the trouble in the sheet re-supply.

By providing means for preventing re-supply of the sheets discharged on the sheet stacking surface, the treated sheets returned to and re-stacked on the non-treated sheet stack can surely be prevented from re-supplying.

According to the present invention, regarding the sheet convey apparatus of ADF type, the limitation of the number of sheets to be treated can be eliminated and the apparatus can be made small-sized.

DETAILED DESCRIPTION OF THE PREFERRED EMBODIMENTS

Figure 1:
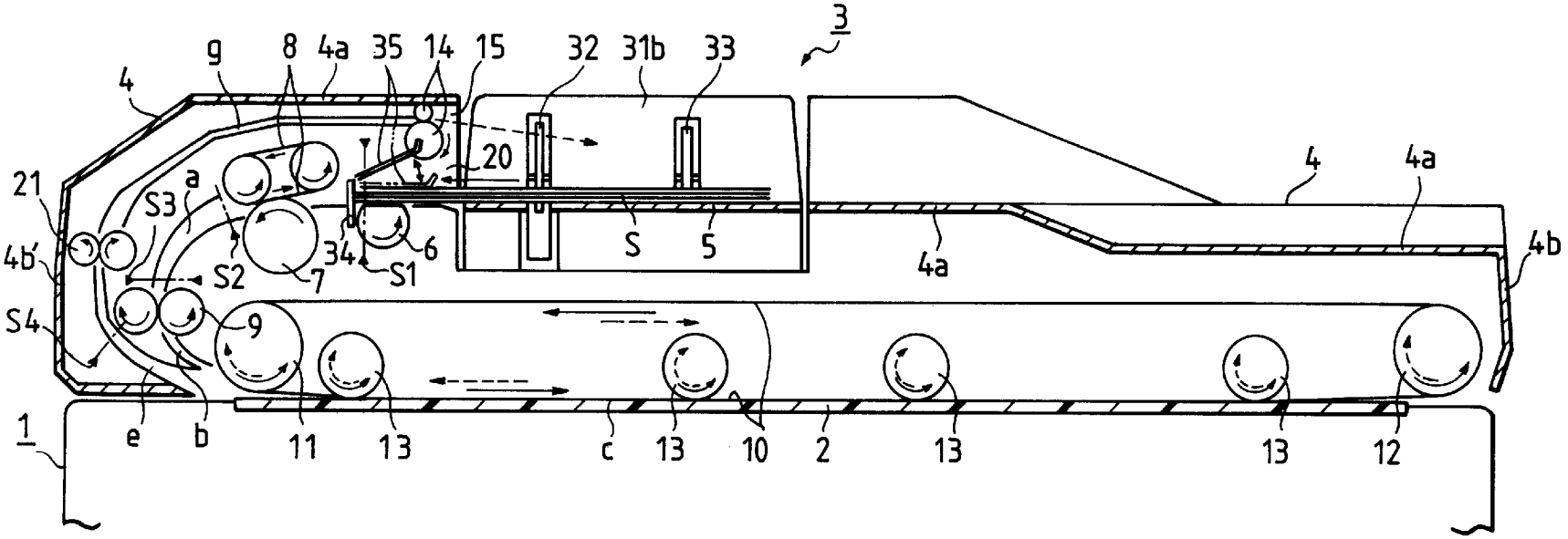
FIG. 1 is a schematic sectional view of a sheet convey apparatus (original convey apparatus) according to a preferred embodiment of the present invention.
Figure 2:
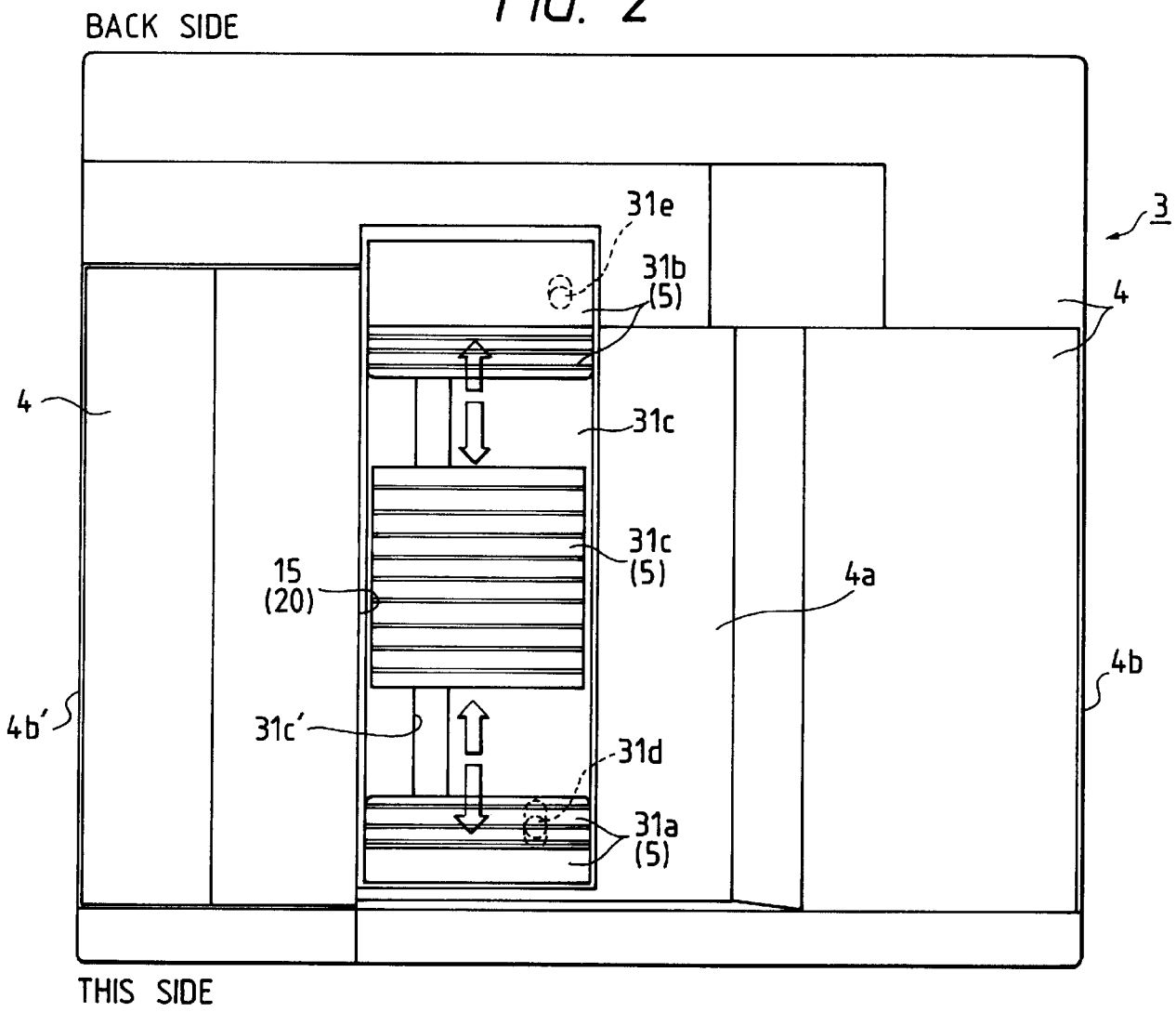
FIG. 2 is a plan view of the sheet convey apparatus.

FIG. 1 is a schematic sectional view of an original convey apparatus (ADF) as an embodiment of a sheet convey apparatus according to the present invention, and FIG. 2 is a plan view of the original convey apparatus. Incidentally, the same constructural elements as those shown in FIG. 13 are designated by the same reference numerals and explanation thereof will be omitted.

Figure 13:
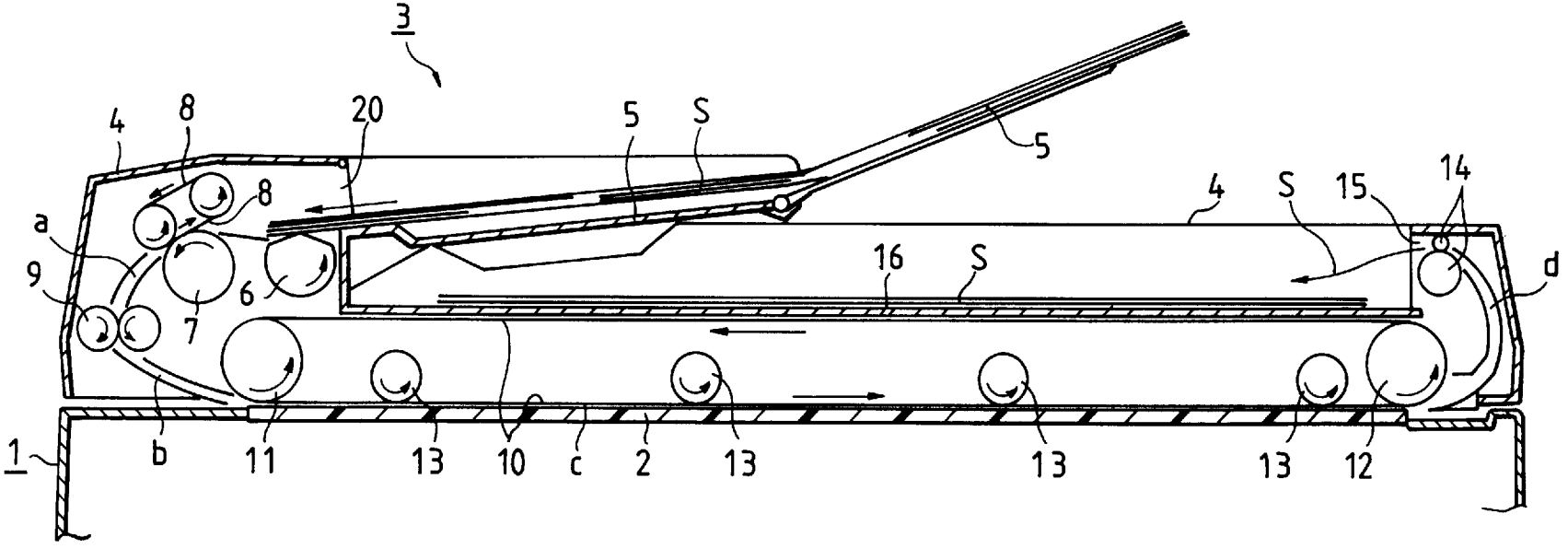
FIG. 13 PRIOR ART
FIG. 13 is a sectional view showing an example of a conventional sheet convey apparatus.
Figure 14:
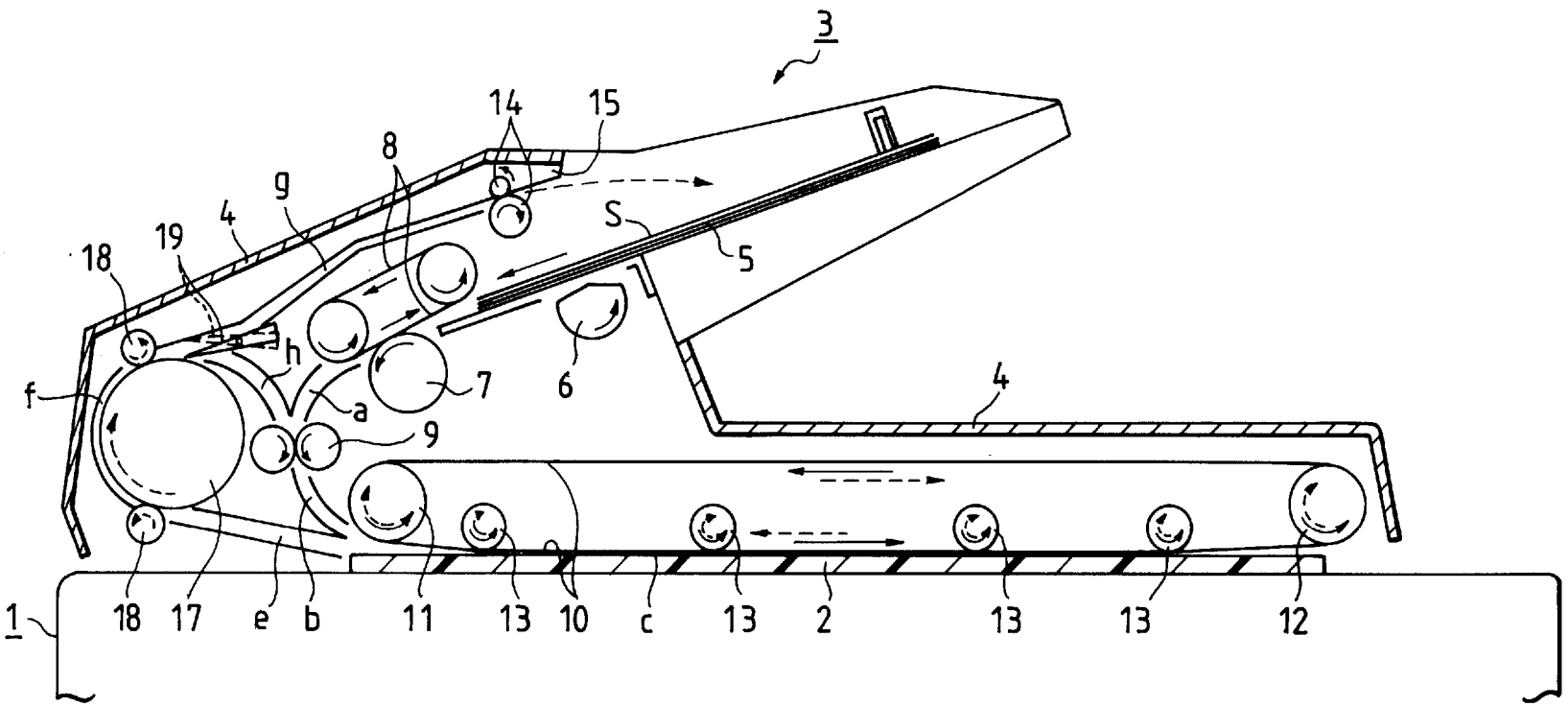
FIG. 14 PRIOR ART
FIG. 14 is a sectional view showing another example of a conventional sheet convey apparatus.

Originals S stacked on an original tray (original stacking plate) 5 are separated one by one from the lowermost one by a supply roller 6 and a separation and supply portion 7, 8, as is in the case shown in FIG. 13, and the separated original is automatically conveyed to and set on a platen glass 2 through a sheet path a, a pair of regist rollers 9, a sheet path b and a sheet path c. Then, image information of the original is read.

When the reading process is finished, a rotatable original convey belt 10 is rotated reversely in a clockwise direction to return the original on the platen glass 2 to the left to introduce the original into a return path e. Then, the original is returned onto the original tray 5 through a pair of relay convey rollers 21, a discharge sheet path g, a pair of discharge rollers 14 and a discharge opening 15 to be re-stacked on the non-treated original stack S on the original tray 5.

The original tray 5 cooperates with a cover 4 to provide a substantially horizontal original stacking surface and is arranged above the platen glass with the interposition of the original convey belt 10. That is, a portion 4*a* of an upper surface of the cover 4 cooperates with the original tray 5 to form a substantially horizontal tray. The cover includes a right side wall 4*b*, a left side wall 4*b*' and a front wall (not shown).

A pair of front and back L-shaped side guides 31*a*, 31*b* (FIG. 2) serve to regulate side edges of the original stack S rested on the original tray 5, and side guide holding member (original tray 5) 31*c* serves to hold the pair of front and back side guides 31*a*, 31*b*. The holding member 31*c* is provided with a groove 31*c*' for permitting the shifting movements of the side guides 31*a*, 31*b*. Ribs are formed on a central portion of the holding member 31*c* and horizontal surfaces of the side guides 31*a*, 31*b* so that the originals are rested on these ribs.

The side guide holding member 31*c* is held by the cover 4. The original stacking surface is formed substantially horizontally by the horizontal surfaces of the front and back side guides 31*a*, 31*b*, surface of the side guide holding member 31*c* and surface of the cover 4. By manually shifting the side guides 31*a*, 31*b* as shown by the arrows in FIG. 2, the side edges of the original stack S on the original tray 5 are regulated.

The side guide holding member 31*c* is shiftable with respect to the cover 4 in an up-and-down direction (widthwise direction of the original) in FIG. 2 to correct the deviation of the original in a direction perpendicular to an original conveying direction (i.e., lateral register deviation) caused upon the conveyance of the original. The side guide holding member 31*c* is secured to the cover 4 by tightening a screw 31*d* from a front side and by tightening a stepped screw 31*e* from a back side to permit the sliding movement of the holding member regarding the cover. To correct the lateral register deviation, the screw 31*d* is loosened, and the holding member 31*c* is shifted by a predetermined amount, and then the screw 31*d* is tightened again. The screws 31*d*, 31*e* are so positioned that they are not exposed outside normally, but they are exposed outside only when the side guides 31*a*, 31*b* having low frequency of use are shifted.

In FIG. 1, a cycle lever 32 for detecting the end of a supply cycle of the originals S stacked on the original tray 5 and a pre-cycle lever 33 for detecting the presence/absence of the original before the supply cycle end are arranged at a side of the rear side guide 31*b*. A stopper 34 serves to align tip ends of the originals S with each other when the originals S are stacked on the original tray 5 in a condition that the tip ends of the originals are inserted into an original inlet portion 20. The stopper 34 is normally protruded in an original convey path, but can be retarded from the original convey path in response to an original supply start signal.

A weight member 35 rockable in the up-and-down direction is arranged above the supply roller 6. The weight member 35 is normally retarded from the supply roller 6 as shown by the solid line. However, when the original supply start signal is emitted, the weight member is lowered by its own weight on the front end portion of the original stack S as shown by the phantom line to cooperate with the supply roller 6, thereby applying a conveying force to the lowermost original of the original stack S.

At an outside of the original convey path constituted by the supply roller 6, original separation and supply portion 7, 8, sheet path a, paired register rollers 9, sheet path b, and sheet path c, there is arranged another original convey path starting from an original return outlet portion of the sheet path c and comprising the return sheet path e, paired relay convey rollers 21, discharge sheet path g, paired of discharge rollers 14 and discharge opening 15. The discharge opening 15 is arranged above the original stacking surface (i.e., above the supply roller 6) and at an upstream side of the supply roller (sheet supply means) 6 in the original conveying direction.

A first original sensor S1 is an empty sensor for detecting the presence/absence of the original set on the original tray 5 and for discriminating whether the original is treated or is not still treated, a second original sensor S2 serves to detect the fact that the original leaves the separation and supply portion 7, 8, a third original sensor S3 is a regist sensor for detecting the fact that the original reaches the nip between the regist rollers 9, and a fourth original sensor S4 is a discharge sensor disposed in the return sheet path e and adapted to aid the speed control of the discharged original.

Figure 3:
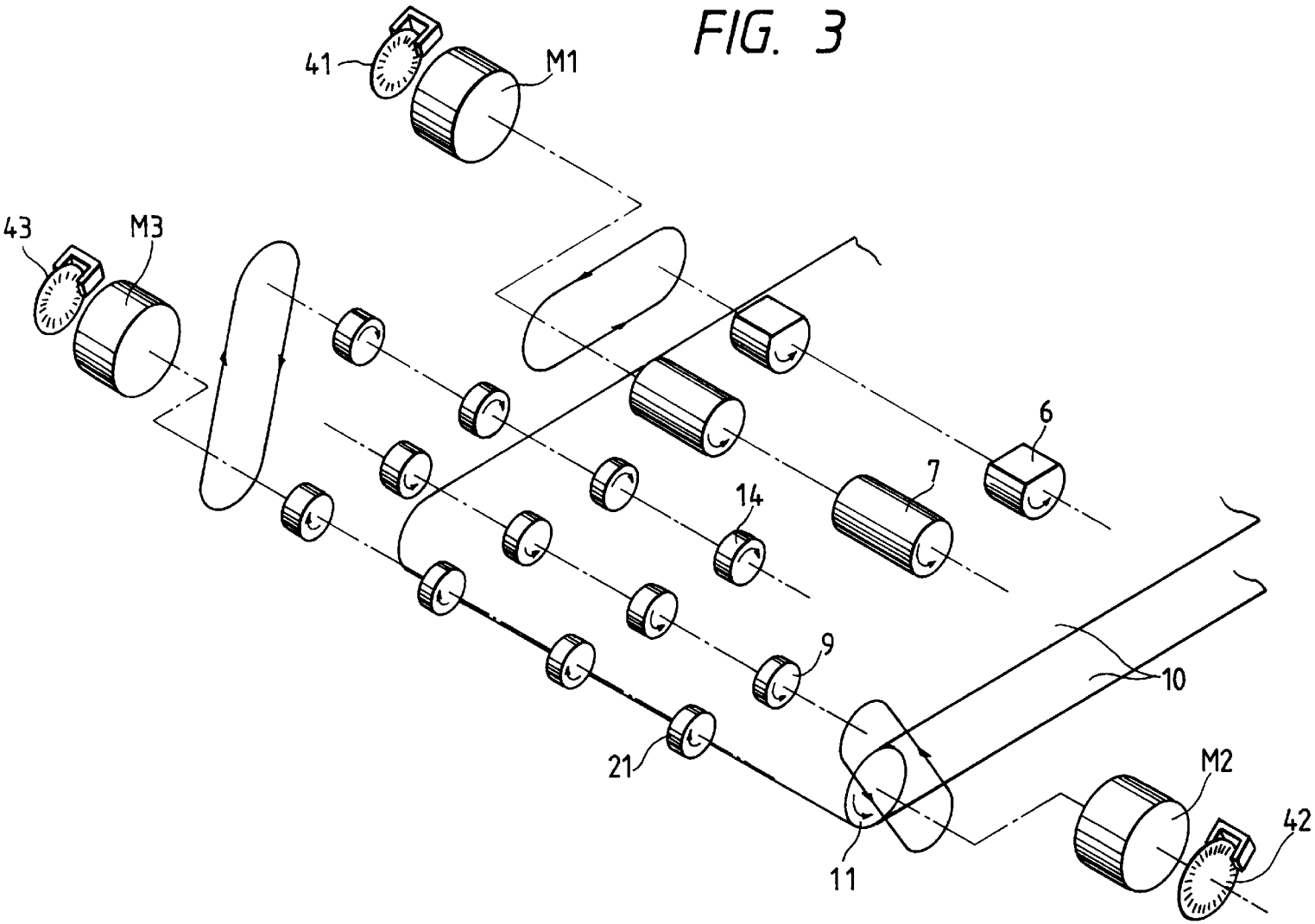
FIG. 3 is a schematic perspective view showing a drive system.

FIG. 3 shows a drive system schematically. This drive system comprises a supply and separation motor M1 for driving the supply roller 6 and the separation and supply portion 7, 8, a belt motor M2 for driving the regist rollers 9 and the drive roller 11 of the original convey belt 10, and a discharge motor M3 for driving the relay convey rollers 21 and the discharge rollers 14. The belt motor M2 has a braking mechanism for controlling the motor. The motors M1, M2, M3 are associated with encoders 41, 42, 43 for detecting the number of revolutions of the motors, respectively, so that the motors M1, M2, M3 are controlled in a body by a control system (not shown).

Figure 4:
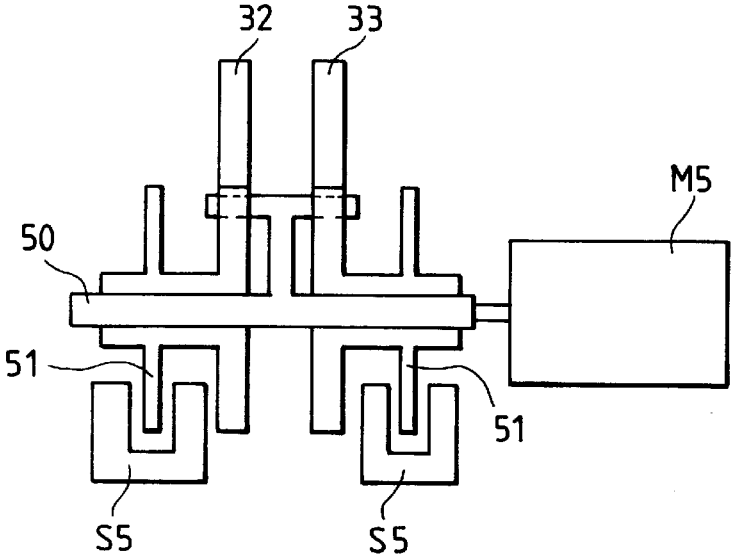
FIG. 4 is a view showing a cycle lever mechanism.

FIG. 4 schematically shows a cycle lever mechanism, and FIGS. 5A, 5B, 6A, 6B, 7A, 7B, 8A and 8B show operations of the cycle levers 32, 33.

The cycle levers 32, 33 are rotated by a rotary member 50 connected to a shaft portion of a cycle motor M5. Angular positions of the cycle levers 32, 33 are detected by flags 51 integrally formed with the cycle levers, and fixed sensors S5 associated with the flags. The cycle levers 32, 33 serve to sort or divide the non-treated originals stacked on the original tray 5 from the treated originals discharged onto the non-treated original stack by being inserted between the non-treated original stack and the treated original stack.

Figure 5A:
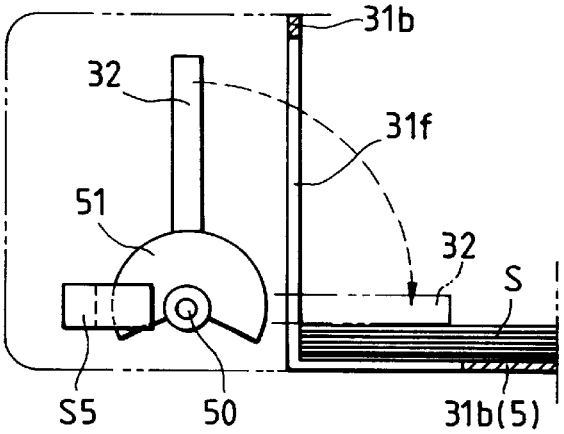
FIGS. 5A and 5B are views showing a condition that the cycle lever is in a waiting position.
Figure 5B:
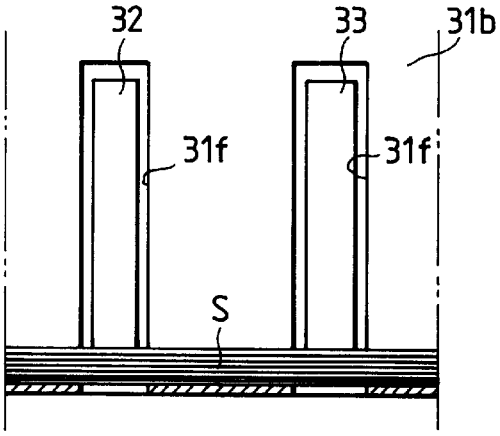
Figure 6A:
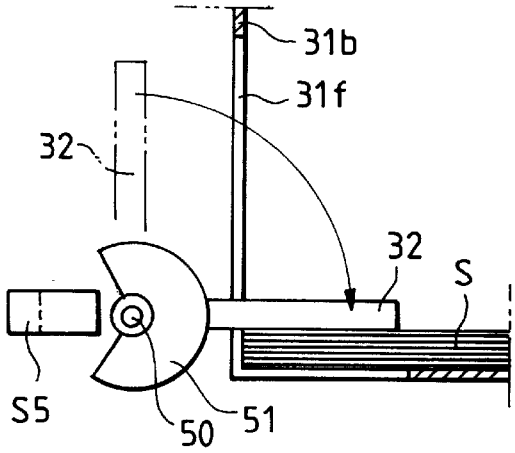
FIGS. 6A and 6B are views showing a condition that the cycle lever is in a laid-down position.
Figure 6B:
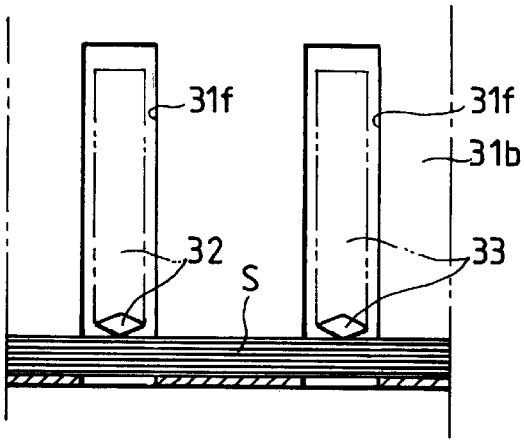

The cycle levers 32, 33 are normally held in an upright condition as shown in FIGS. 5A and 5B so that they are retarded within the rear side guide 31*b*. In this condition, light paths of the sensors S5 are blocked by the corresponding flags 51, thereby turning the sensors OFF. After the originals S are stacked and set on the original tray 5, the cycle levers 32, 33 are rotated in clockwise directions in FIG. 5A by the motor M5 in response to the original supply start signal. The cycle levers 32, 33 are laid down toward the original stack S through notches 31*f* formed in the rear side guide 31*b* to be rested on the original stack S on the original tray 5 as shown in FIGS. 6A and 6B. In this condition, the light paths of the sensors S5 are aligned with slits of the flags 51, thereby turning the sensors S5 ON.

Figure 7A:
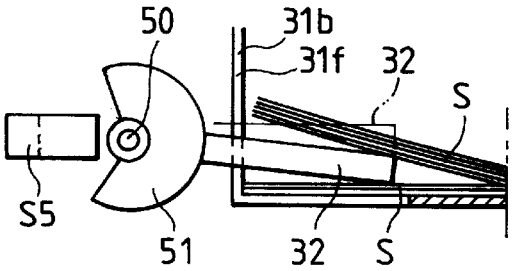
FIGS. 7A and 7B are views showing a condition that non-treated sheets are sorted or divided from treated sheets by the cycle lever.
Figure 7B:
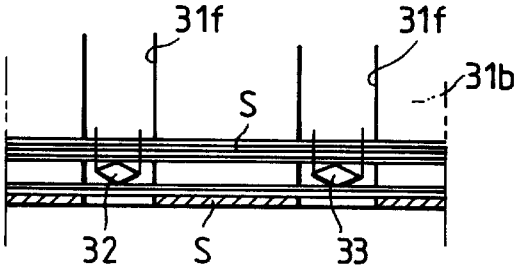

In this condition, the originals are supplied successively, and the treated originals S are successively returned onto the original tray 5 to be re-stacked on the non-treated originals S as shown in FIGS. 7A and 7B. In this case, since the cycle levers 32, 33 exist between the non-treated originals S and the treated originals stacked on the non-treated originals, the treated originals are divided from the non-treated originals and the sensors S5 are turned ON. Accordingly, the information that the non-treated original S remains on the original tray 5 is inputted to the control system.

Figure 8A:
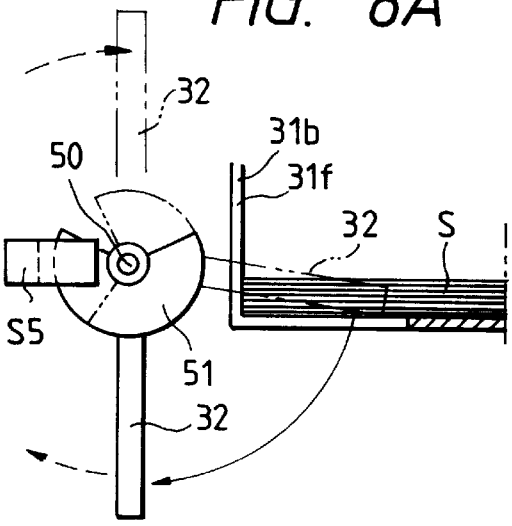
FIGS. 8A and 8B are views showing a condition that the cycle lever reaches a depended position after the last sheet was fed out.
Figure 8B:
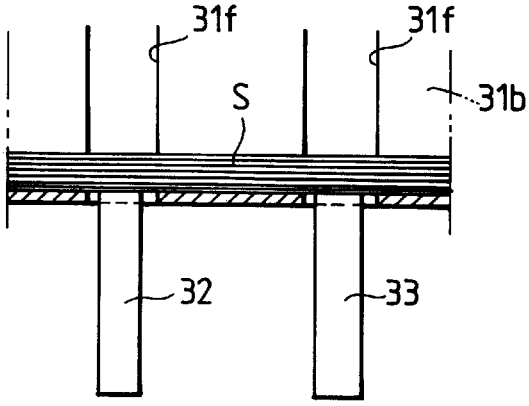

The non-treated originals S continue to be supplied successively. When the last non-treated original is supplied, since the cycle levers 32, 33 are not supported by the non-treated original, as shown in FIGS. 8A and 8B, the cycle levers 32, 33 are dropped through the notches 31*f* of the rear side guide 31*b* by their own weights to become a depended condition. In this condition, the light paths of the sensors S5 are blocked by the corresponding flags 51, thereby turning the sensors S5 OFF. On the basis of such OFF signal, the control system judges that the supplying operation for the originals S firstly set on the original tray 5 is completed.

Thereafter, the depended cycle levers 32, 33 are rotated by the motor M5 to the upright condition (waiting condition) as shown in FIGS. 5A and 5B.

Next, the operation of the apparatus will be explained.

(i) The originals S are set on the original tray 5 between the front and rear side guides 31*a*, 31*b* in such a manner that the tip ends of the originals are abutted against the stopper 34 in the original inlet portion 20. The fact that the originals were set on the original tray 5 is detected by the empty sensor S1, and this information is inputted to the control system.

(ii) Thereafter, on the basis of the original supply start signal, the cycle levers 32, 33 are laid down, the stopper 34 is retarded and the weight member 35 is lowered onto the original stack S. Then, the supply and separation motor M1 is turned ON to rotate the supply roller 6 which cooperates with the weight member 35 to apply the sufficient conveying force to the lowermost original of the original stack, with the result that the lowermost original is separated from the other originals at the separation and supply portion 7, 8.

(iii) The separated original passes through the sheet path a and is then abutted against the nip between the regist rollers 9 which are now stopped. The fact that the tip end of the original reaches the nip is detected by the regist sensor S3. By further feeding the original, a loop is formed in the original to correct the skew-feed of the original, and then the supply and separation motor M1 is stopped.

(iv) Thereafter, the supply and separation motor M1 and the belt motor M2 are driven simultaneously at the predetermined timing (belt motor M2 is rotated in a normal direction), thereby rotating the separation and supply portion 7, 8 and the paired regist rollers 9 and rotating the original convey belt 10 in a normal direction, with the result that the original stopped by the regist rollers 9 is passed through the sheet path b to enter into the sheet path c in which the original is shifted on the platen glass 2 from the left to the right.

When a predetermined time period is elapsed after the trailing end of the original was detected by the regist sensor S3, the belt motor M2 is turned OFF, thereby setting the original at the predetermined set position on the platen glass 2. Then, the image information on the original is read by the reading mechanism of the image forming apparatus.

(v) During the reading process, the next original on the original tray 5 is separated and is supplied until the tip end thereof is abutted against the nip between the regist rollers 9 which are now stopped (waiting condition).

(vi) When the reading process regarding the original set on the platen glass 2 is completed, the belt motor M2 is rotated in a reverse direction, thereby returning the original on the platen glass 2 to the return path e. At the same time, the discharge motor M3 is turned ON. After the tip end of the original entered to the return path e is detected by the discharge sensor S4, when the original is conveyed by a predetermined amount so that the original is positively pinched by the relay rollers 21, the belt motor M2 is turned OFF.

After a predetermined time period is elapsed, as in the above case (iv), the supply and separation motor M1 and the belt motor M2 are turned ON to convey the next original waiting at the paired regist rollers 9 to the platen glass 2. In this way, the originals are exchanged.

(vii) Further, the original (which was already read) pinched by the relay rollers 21 in the above course (vi) is discharged onto the original tray 5 through the discharge path g, paired discharge rollers 14 and discharge opening 15. In this case, after the trailing end of the original is detected by the discharge sensor S4, immediately before the trailing end of the original leaves the pair of discharge rollers 14 (determined by a counter), the speed of the discharge motor M3 is controlled so that the original is softly discharged onto the original stack on the original tray 5. As mentioned above, the treated originals discharged onto the original tray 5 are divided from the non-treated originals on the original tray 5 by the cycle levers 32, 33 (FIGS. 4 to 8A and 8B).

Technical effects obtained by the aforementioned embodiment are as follows:

(1) In the original convey apparatus as a sheet convey apparatus according to this embodiment, since the original stacking surface is also used as the original discharge surface, the number of originals to be treated is not limited.

(2) Since the original stacking surface is positioned substantially horizontally and is disposed immediately above the original convey belt 10 (convey means) for conveying the original on the platen glass 2 acting as the sheet treatment portion (original reading portion), the height of the apparatus can be reduced, thereby making the apparatus small-sized.

(3) Since the original stacking surface is positioned substantially horizontally, the treated originals returned onto the non-treated original stack on the original stacking surface (FIGS. 7A and 7B) are not positively shifted in the original supplying direction, with the result that the treated originals are not re-supplied because they do not enter into the original inlet portion 20 (i.e., not detected by the sensor S1).

(4) In the apparatus according to this embodiment, since the discharge opening 15 is disposed above the supply roller (supply means) 6 with respect to the original stacking surface and is arranged at the upstream side of the supply roller 6 in the original supplying direction, the trailing ends of the discharged originals are not rested on the supply roller 6, thereby preventing the re-supply of the discharged originals.

(5) Further, by providing the weight member 35 in connection with the supply roller 6, the trailing ends of the discharged originals are prevented from resting on the supply roller 6 and resting directly on the non-treated original stack to be supplied to the separation and supply portion 7, 8, thereby preventing the re-supply of the discharged originals.

(6) As mentioned above (FIGS. 4 to 8A, 8B), by providing the cycle levers 32, 33 for dividing the non-treated originals on the original tray 5 from the treated originals discharged returned onto the original tray 5, it is possible to prevent the treated originals from being re-supplied. That is to say, when the cycle levers 32, 33 are rotated to the depended condition as shown in FIGS. 8A and 8B to turn the sensors S5 OFF after the last non-treated original on the original tray 5 was supplied (i.e., when the supply of the last original is finished), by prohibiting the further sheet supplying operation, it is possible to prevent the treated originals from being re-supplied.

Incidentally, the cover 4 forms a part of an outer wall of the image forming apparatus and is normally formed from a molded part which contains various elements such as rollers, belt and the like therein. Further, the body 3 of the image forming apparatus can be opened toward that side of the apparatus to permit manual setting of the original on the platen glass 2.

Next, another embodiment will be explained.

Figure 9:
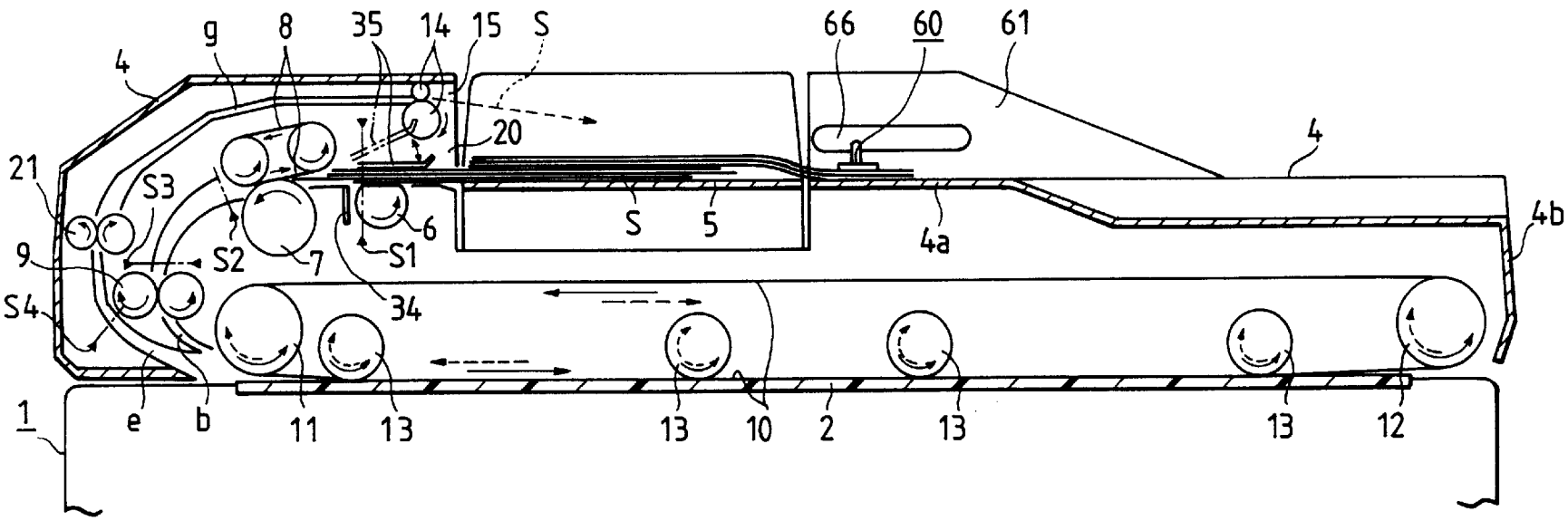
FIG. 9 is a schematic sectional view of a sheet convey apparatus according to another embodiment of the present invention.
Figure 10:
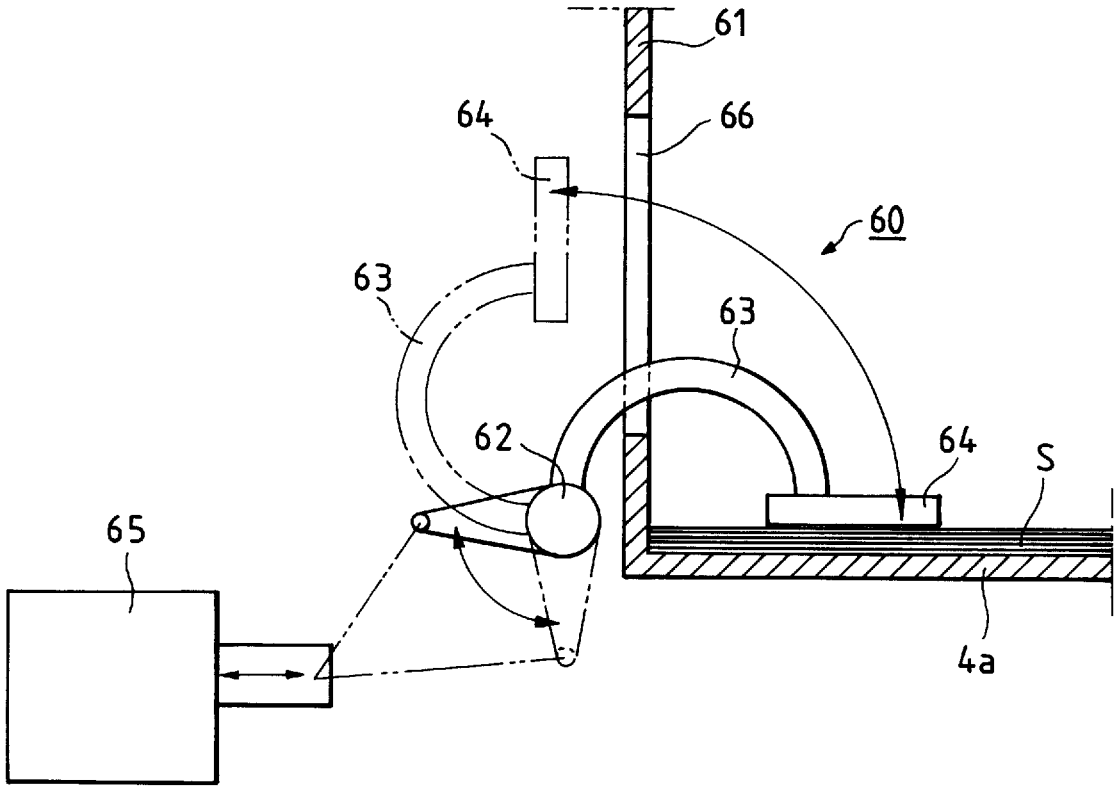
FIG. 10 is a view showing an operation of an urging lever portion for urging the treated sheets.

In a sheet convey apparatus shown in FIGS. 9 and 10, a holding means 60 for holding tip ends (in the discharge direction) of the discharged originals is provided at a rear side plate portion 61.

As shown in FIG. 10, the holding means 60 comprises an original urging lever 63 rockable around a shaft 62, an original urging pad 64 provided at a free end of the lever, and a solenoid 65 for rocking the original urging lever 63. Further, the holding means 60 can be shifted in the original supplying direction to treat various originals having different sizes. Upon the supply of the original, the holding means 60 is shifted by a predetermined amount in accordance with the detected size of the original. This predetermined amount defines a position where only the tip ends (in the discharge direction) of the discharged originals are held by the urging pad 64 on the basis of the deviation amount caused by the positional relation between the supply roller 6 and the discharge means 14, and the size of the original.

When the original is discharged onto the original tray 5 (4*a*), the original urging lever 63 is rotated by the solenoid 65 to an upright position as shown by the phantom line in FIG. 10 to retard from the original tray 4*a* to the outside of the rear side plate portion 61, thereby not preventing the smooth discharge of the originals.

Upon the supply of the original, the original urging lever 63 are rotated by the solenoid 65 to a position shown by the solid line in FIG. 10, where the tip ends of the discharged originals are urged against the original tray 4*a* by the urging pad 64. After this, the supply roller 6 is rotated to supply the non-treated originals on the original tray 4*a* one by one. In this case, since the tip ends of the discharged originals are urged against the original tray 4*a* by the urging pad 64, such discharged originals are not re-supplied.

After the supply roller 6 is stopped, the original urging lever 63 is rotated to the retarded position shown by the phantom line in FIG. 10 again for preparation for the next original discharge onto the original tray 4*a*.

Next, a further embodiment will be explained.

Figure 11:
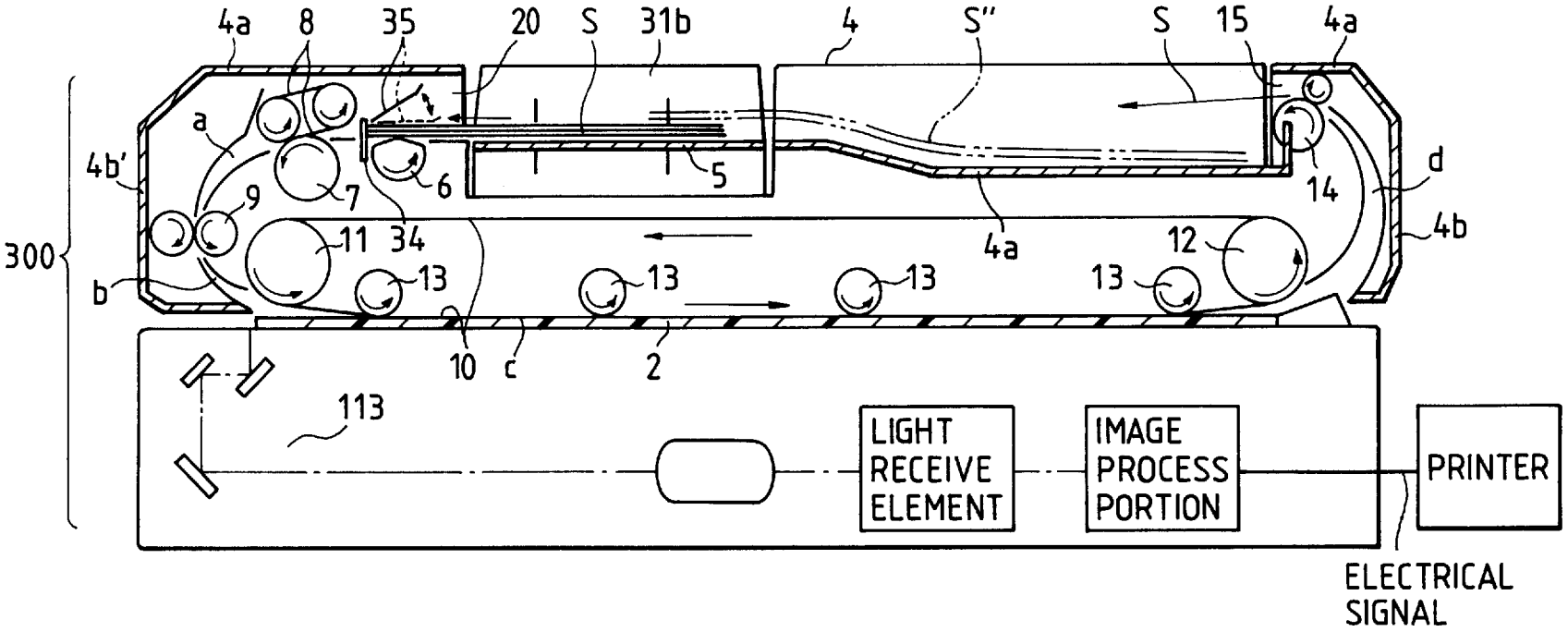
FIG. 11 is a schematic sectional view of a sheet convey apparatus according to a further embodiment of the present invention.

In an apparatus shown in FIG. 11, similar to the apparatus as shown in FIG. 13, the original is supplied to the platen glass 2 from one side thereof, and is discharged from the other side of the platen glass to pass through the sheet path d, paired discharge rollers 14 and discharge opening 15.

Also in this apparatus, the original stacking surface is also used as the original discharge surface, and the original stacking surface is formed substantially horizontally by the cooperation of the original tray and the cover 4*a* and is arranged immediately above the original convey belt 10 for conveying the original on the platen glass 2. Accordingly, the height of the apparatus can be reduced, thereby making the apparatus small-sized. Incidentally, when originals S" having large size are used, such originals are discharged as shown by the two dot and chain line.

Lastly, an example of an image forming apparatus to which the original convey apparatus according to the first, second or third embodiment will be explained.

Figure 12:
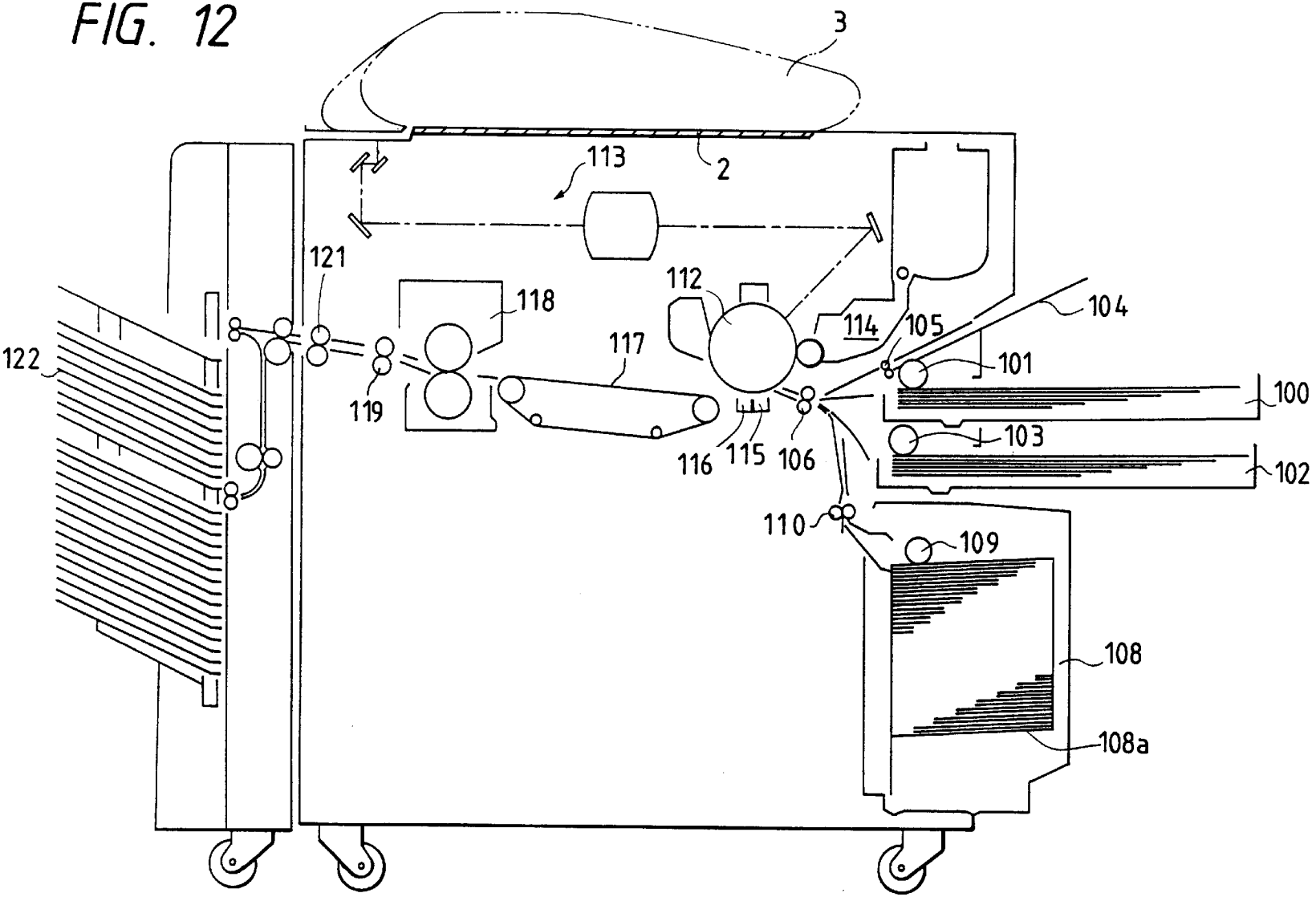
FIG. 12 is an elevational sectional view of an image forming apparatus.

In FIG. 12, sheets contained in an upper cassette 100 are separated one by one by a separation pawl (not shown) and a sheet supply roller 101, and the separated sheet is sent to a pair of regist rollers 106. On the other hand, sheets contained in a lower cassette 102 are separated one by one by a separation pawl (not shown) and a sheet supply roller 103, and the separated sheet is sent to the pair of regist rollers 106. In a manual sheet supply, a sheet is inserted through a manual insertion guide 104 and is sent to the pair of regist rollers 106 via rollers 105. A sheet stacking device (of deck type) 108 comprises an intermediate plate 108a lifted and lowered by a motor and the like. The sheets rested on the intermediate plate are separated one by one by a separation pawl and a sheet supply roller 109, and the separated sheet is sent to a convey roller 110.

An image forming portion is constituted by a photosensitive drum 112, an optical reading system 113, a developing device 114, a transfer charger 115, and a separation charger 116.

The reference numeral 117 denotes a convey belt for conveying the sheet on which the image was formed; 118 denotes a fixing device; 119 denotes convey rollers; and 120 denotes a flapper. The sheet on which the image was fixed is directed, by the flapper 120, to a pair of sheet discharge rollers 121 by which the sheet is sent to a sorter 122. In place of the sorter, discharge tray may be used.

Regarding the original set on the platen glass, images corresponding to the number of copies to be obtained, are successively formed on the photosensitive drum. And, whenever the image is formed on the photosensitive drum, the sheet is supplied from the cassette 100 or 102 or from the deck 108. The registration between the image formed on the photosensitive drum and the sheet is effected by the pair of regist rollers 106.

When the desired number of copies are obtained, the original is discharged from the platen glass, and the next original is set on the platen glass. In this way, the copying operations are repeated.

Incidentally, a reading unit (reading apparatus 300) may be formed by incorporating the optical reading system 113 into the automatic original convey apparatus, and such a unit may be connected to the image forming apparatus via a cable and the like so that the read image can be outputted as an output image.

What is claimed is:

1. A sheet convey apparatus comprising:

a cover forming an outer wall of a main body of said apparatus;

a sheet stacking tray for stacking sheets thereon;

a movable side guide for regulating a side edge of the sheet on said sheet stacking tray;

supply means for supplying the sheet from said sheet stacking tray in a first feeding direction of a sheet;

a sheet separation means downstream from said supply means in said first feeding direction;

convey means normally rotating for conveying the sheet separated by said separation means to a treatment position, and reversely rotating for returning the sheet from the treatment position; and discharge means disposed at the same side as said separation means relative to said sheet stacking tray for discharging the sheet returned from the treatment position to a sheet stacking position by said convey means to recycle the sheet, wherein said discharge means is disposed above said supply means to oppose a discharge opening through which the sheet is discharged, said supply means being disposed at a position retracted from the discharge opening and from said discharge means in a sheet conveying direction, and said sheet stacking tray cooperates with an upper surface of said cover to provide a substantially horizontal stacking surface arranged immediately above said convey means, so that said discharge means discharges the sheet at a position where a trailing end of the sheet in a return direction is not subject to a supply force of said supply means.

2. An automatic original reading apparatus which has a sheet convey apparatus according to claim 1 and in which the sheet on said treatment portion is read by an optical system.

3. An image forming apparatus which has a sheet convey apparatus according to claim 1 and in which the sheet on said treatment portion is read by an optical system and a read image is formed on a sheet at an image forming portion.

4. A sheet convey apparatus according to claim 1, further comprising sheet re-supply preventing means for preventing the sheet discharged on said sheet stacking tray from re-supplying.

5. A sheet convey apparatus according to claim 4, wherein said sheet re-supply preventing means comprises sort means for sorting non-treated sheets rested on said sheet stacking tray and to be supplied to said treatment portion from the sheets discharged onto said sheet stacking tray.

6. A sheet convey apparatus according to claim 4, wherein said sheet re-supply preventing means comprises a stopper member adapted to be abutted against an upper surface of a stack of the sheets rested on said sheet stacking tray and to be supplied, said stopper member being arranged between a discharge opening of said discharge means through which the sheet is discharged onto said sheet stacking plate and said supply means.

7. A sheet convey apparatus according to claim 3, wherein said sheet re-supply preventing means comprises holding means for holding tip ends of the sheets discharged onto said sheet stacking tray surface, said tip ends being leading ends of the sheet in a sheet discharging direction.

* * * * *

UNITED STATES PATENT AND TRADEMARK OFFICE

CERTIFICATE OF CORRECTION

PATENT NO. : 5,871,208

DATED : February 16, 1999

INVENTOR(S) : KATSUAKI HIRAI, ET AL.

It is certified that error appears in the above-identified patent and that said Letters Patent is hereby corrected as shown below:

COLUMN 2,
Line 21, "constructural" should read --structural--; and
Line 29, "regist" should read --register--.

COLUMN 4,
Line 23, "regist" should read --register--.

COLUMN 5,
Line 36, "of" should be deleted;
Line 47, "regist" should read --register--;
Line 49, "regist" should read --register--; and
Line 55, "regist" should read --register--.

COLUMN 6,
Line 67, "regist" should read --register--.

COLUMN 7,
Line 2, "regist" should read --register--;
Line 10, "regist" should read --register--;
Line 12, "regist" should read --register--;
Line 17, "regist" should read --register--;
Line 24, "regist" should read --register--; and
Line 38, "regist" should read --register--.

UNITED STATES PATENT AND TRADEMARK OFFICE

CERTIFICATE OF CORRECTION

PATENT NO. : 5,871,208

DATED : February 16, 1999

INVENTOR(S) : KATSUAKI HIRAI, ET AL.

It is certified that error appears in the above-identified patent and that said Letters Patent is hereby corrected as shown below:

COLUMN 8,
Line 39, "belt" should read --belts--.

COLUMN 9,
Line 38, "regist" should read --register--;
Line 41, "regist" should read --register--; and
Line 65, "regist" should read --register--.

COLUMN 10,

Line 66, "claim 3," should read --claim 4,--.

COLUMN 11,
Line 2, "tray surface," should read --tray,--.

Signed and Sealed this
Twenty-fifth Day of January, 2000

*Attest:*

*Attesting Officer*

*Acting Commissioner of Patents and Trademarks*